US011904386B2

(12) United States Patent
Liang

(10) Patent No.: US 11,904,386 B2
(45) Date of Patent: Feb. 20, 2024

(54) CASTING LADLE FOR CASTING ALUMINUM ALLOY

(71) Applicant: CITIC Dicastal Co., Ltd., Qinhuangdao (CN)

(72) Inventor: Xin Liang, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 180 days.

(21) Appl. No.: 17/775,459

(22) PCT Filed: Oct. 20, 2020

(86) PCT No.: PCT/CN2020/122014

§ 371 (c)(1),
(2) Date: May 9, 2022

(87) PCT Pub. No.: WO2021/212781

PCT Pub. Date: Oct. 28, 2021

(65) Prior Publication Data

US 2023/0050493 A1 Feb. 16, 2023

(30) Foreign Application Priority Data

Apr. 24, 2020 (CN) ..... 202010331534.8

(51) Int. Cl.
*B22D 41/02* (2006.01)

(52) U.S. Cl.
CPC ..... *B22D 41/02* (2013.01)

(58) Field of Classification Search
CPC ..... B22D 41/02
See application file for complete search history.

(56) References Cited

FOREIGN PATENT DOCUMENTS

CN 104226970 A * 12/2014

OTHER PUBLICATIONS

English machine translation of CN 104226970 A (Year: 2014).*

* cited by examiner

*Primary Examiner* — Kevin P Kerns
*Assistant Examiner* — Steven S Ha
(74) *Attorney, Agent, or Firm* — IPro, PLLC

(57) ABSTRACT

Disclosed is a casting ladle for casting aluminum alloy in the present application. The casting ladle includes a liner contact layer, a first thermal insulation layer, a second thermal insulation layer, and a housing layer sequentially from inside to outside. The first thermal insulation layer includes first $Al_2O_3$ particles and at least one first oxide particle selected from the group consisting of first $SiO_2$ particles, first CaO particles, and first MgO particles. The second thermal insulation layer includes at least one second oxide particle selected from the group consisting of second $Al_2O_3$ particles, second $SiO_2$ particles, second CaO particles, and second MgO particles. The second thermal insulation layer has a porosity of 60-75% and a pore size of 2-5 mm.

10 Claims, 2 Drawing Sheets

CASTING LADLE FOR CASTING ALUMINUM ALLOY

TECHNICAL FIELD

The present invention belongs to the field of metal materials and metallurgy, and in particular relates to a casting ladle for casting aluminum alloy.

BACKGROUND

At present, there are serious challenges in terms of energy regeneration, resource sustainability, environmental protection and other aspects. Energy consumption and environmental problems are solved by lightweighting in the field of aerospace, heavy industry, transportation and so on. Aluminum alloys, as primary lightweight materials, play a critical role for reducing automobile emissions and saving energy. Meanwhile, aluminum alloys have good electrical and thermal conductivity, corrosion resistance and casting properties, which allows their application in engineering structural materials to increasingly expand. With the development of the industry, there is an increasing demand for lightweight aluminum alloy materials, in which cast aluminum alloys account for up to 68.5% of all aluminum alloy products. The cast aluminum alloys have a simple molding process, and low requirement for equipment. Aluminum alloys can be cast into various shapes of aluminum alloy castings due to good flowability thereof. Methods of preparing aluminum alloy castings mainly include gravity casting, low-pressure casting, differential-pressure casting, high-pressure casting, and the like. These casting methods generally include converting a solid metal into a liquid molten metal aluminum by smelting, and then mold-filling a specific cavity with the liquid molten metal aluminum, finally forming a required casting. Solid metal aluminum ingots are mainly transported through a casting ladle after melting, thus the performance of the casting ladle has become an increasingly important concern for aluminum alloy researchers.

Specifically, after solid metal aluminum ingots are melted into molten aluminum by a melting furnace, the molten aluminum is introduced into a holding furnace for adjustment of chemical ingredients, standing and thermal insulation, then introduced into a casting ladle for refinement, modification, degassing, and refining, and finally transferred to a casting process. In this process, since most of the casting ladles currently used cannot be heated and have a poor thermal insulation effect, a temperature of molten aluminum in the casting ladles would be decreased greatly. Research results on an aluminum alloy melt at home and abroad show that a viscosity of the aluminum alloy melt increases with decrease of the temperature within 700-730° C. The increase of viscosity of the aluminum alloy melt is not conducive to the floating of hydrogen bubbles and slag inclusion in the degassing process, which has a great impact on the quality of subsequent castings. Therefore, the temperature of the aluminum melt cannot drop too much during the process of being introduced from the holding furnace into the casting ladle and then refinement, modification, degassing and refining, otherwise the quality of castings may be affected. In addition, the poor thermal insulation effect of casting ladles leads to the need to use natural gas to bake the casting ladles when molten aluminum is transferred again, resulting in energy waste and environmental pollution. Therefore, the thermal insulation performance of casting ladles becomes a focus of increasing attention of the aluminum alloy researchers.

Similarly, domestic and foreign researches have found that there is a serious aluminum adhesion phenomenon in existing casting ladles. Inner wall materials of casting ladles are in contact with high-temperature molten aluminum for a long time, and thus an oxidation reaction occurs, and a wetting angle of the inner wall materials gradually decreases, resulting in the condition that inner surfaces of the casting ladles are seriously adhered with aluminum and difficult to clean, the capacity of casting ladles becomes smaller, and the amount of slag inclusion in the molten aluminum becomes more and more, resulting in further deterioration of the quality of molten aluminum.

At present, most of the inner wall materials of casting ladles are a composite ceramic brick. In the process of transferring molten aluminum, the inner wall materials will be subjected to thermal impact, and it is easy to produce cracks on the inner walls of the casting ladles. Generation and expansion of a large number of cracks will eventually lead to the scrapping of casting ladles.

SUMMARY

In view of this, a main objective of the present invention is to provide a casting ladle for casting aluminum alloy, wherein it is ensured that the casting ladle has a good thermal insulation effect by adjusting the porosity and pore size of a first thermal insulation layer and a second thermal insulation layer to use the first thermal insulation layer and the second thermal insulation layer in a matched mode.

The present invention provides a casting ladle for casting aluminum alloy, including a liner contact layer, a first thermal insulation layer, a second thermal insulation layer, and a housing layer sequentially from inside to outside, wherein, the first thermal insulation layer includes first $Al_2O_3$ particles and at least one first oxide particle selected from the group consisting of first $SiO_2$ particles, first CaO particles, and first MgO particles, wherein the first $Al_2O_3$ particles have a hollow spherical structure, a proportion of the first $Al_2O_3$ particles is 80-85 wt % based on a total weight of the first thermal insulation layer, and the first thermal insulation layer has a porosity of 55-65% and a pore size of 0.8-3.0 mm; and the second thermal insulation layer includes at least one second oxide particle selected from the group consisting of second $Al_2O_3$ particles, second $SiO_2$ particles, second CaO particles, and second MgO particles, wherein the second thermal insulation layer has a porosity of 60-75% and a pore size of 2-5 mm.

The thermal insulation performance of the casting ladle provided by the present invention is significantly improved by controlling the porosity of the first thermal insulation layer to be 55-65% and the pore size of the first thermal insulation layer to be 0.8-3.0 mm, and the porosity of the second thermal insulation layer to be 60-75% and the pore size of the second thermal insulation layer to be 2-5 mm, and mainly using $Al_2O_3$ hollow spherical particles in the first thermal insulation layer.

When heat is transferred from high temperature to low temperature, a transfer process before encountering pores is heat conduction in a solid phase, and after encountering the pores, there are two heat transfer paths, one of which is still a transfer through a solid phase, but the heat transfer direction is changed, and the total heat transfer path is greatly increased, thereby slowing down a heat transfer speed; the other heat transfer path is a heat transfer through gas within pores, which mainly includes heat conduction of the gas within the pores, and since a heat conductivity coefficient of the gas is far less than that of a solid, the resistance of the heat transfer through the gas is large, and the heat transfer speed is greatly reduced. Therefore, the heat transfer speed in the solid phase and pores may be simultaneously reduced when the porosity and pore size of the first and second insulation layers of the casting ladle of the present invention are within the above-mentioned range, thereby improving the thermal insulation performance. In addition, it is also necessary to consider tiny flow of gas in the pores because the flow of the gas in the pores accelerates loss of heat. If a pore size is too large, the thermal insulation effect is also reduced, and it is easy to produce cracks under repeated thermal shock of molten aluminum alloy, resulting in an internal aluminizing phenomenon. By reasonably setting the porosity and pore size in the first thermal insulation layer and the second thermal insulation layer, a good thermal insulation effect of the casting ladle of the present invention is achieved.

In addition, the $Al_2O_3$ hollow spherical particles are high-temperature thermal insulation materials, with a maximum use temperature of 1800° C. An article made of the $Al_2O_3$ hollow spherical particles has a high mechanical strength and a low bulk density. Therefore, by using the $Al_2O_3$ hollow spherical particles as a main thermal insulating material of the first thermal insulation layer of the casting ladle, which not only can exert its good heat insulation effect, but also reduce a mass of the casting ladle and save the use of the thermal insulating material.

Since the casting ladle has a multi-layer structure, and thermal expansion coefficients of the layers are generally different, the expansion amounts of the liner contact layer and the first thermal insulation layer are large, and the expansion amount of the housing layer is less, after heat absorption. Cracking may occur between the housing layer and an inner layer. By providing the second thermal insulation layer with a porosity of 60-75% and a pore size of 2-5 mm, an excellent thermal insulating effect can be achieved while ensuring that the inner crack of the casting ladle does not expand. Due to the arrangement of the porosity and pore size of the second thermal insulation layer, a crack may form a stress field at its tip during expanding. However, when the crack expands and contacts the second thermal insulation layer, the stress at the tip of the crack is released by the pores of the second thermal insulation layer, thereby preventing the crack from expanding. In addition, after the liner contact layer comes into contact with the high-temperature molten aluminum, the liner contact layer and the first thermal insulation layer have high temperature and large expansion amount, while the housing layer has low temperature and less amount of thermal expansion due to high material rigidity thereof. Therefore, a large stress may be generated between the inner layer and the housing layer, which can easily cause cracking. The cooperating of the porosity with the pore size of the second thermal insulation layer can compensate the difference in expansion amount between the inner layer and the housing layer due to different heating, and release internal stress, thereby ensuring that no cracking occurs between the housing layer and the inner layer (i.e., the liner contact layer, the first thermal insulation layer and the second thermal insulation layer) during use of the casting ladle. If the porosity and pore size of the second thermal insulation layer are too large, the thermal insulating effect of the casting ladle is poor and the crack expands easily. If the porosity and pore size of the second thermal insulation layer are too small, it will be unfavorable to release the stress at the tips of internal cracks.

At present, the thermal insulation effect of conventional casting ladles is not good. In the process of using the casting ladle to transport molten aluminum alloy, the temperature of the casting ladle decreases. After all the molten aluminum alloy is poured out, the casting ladle needs to be baked with a ladle baker before re-introducing molten aluminum alloy to ensure that the temperature of the casting ladle does not decrease too low. However, ladle baking with the ladle baker requires the use of natural gas as an energy source. The ladle baking process may cause energy waste, increase labor intensity of workers, deteriorate working conditions at the site, and cause environmental pollution. The casting ladle for casting aluminum alloy according to the present invention may achieve a good thermal insulation effect on molten aluminum alloy in the casting ladle. In the process of transporting the molten aluminum alloy by the casting ladle, the temperature of the molten aluminum alloy is reduced by a small amount. When the molten aluminum alloy is poured out of the casting ladle, the temperature of the molten aluminum alloy is high, the viscosity thereof is low, so that it is difficult to adhere to an inner wall of the casting ladle. In addition, the casting ladle for casting aluminum alloy according to the present invention has a good thermal insulation effect, so it is unnecessary to bake the casting ladle when transporting molten aluminum alloy again, thereby saving energy, reducing the labor intensity of workers and reducing the production cost.

According to one embodiment of the present invention, a sphere of the first $Al_2O_3$ particles has an inner hole diameter of 0.3-0.8 μm and a diameter of 40-80 μm. Wherein, the $Al_2O_3$ hollow spherical particles may be any suitable commercially available product, or may be obtained by those skilled in the art using any method of preparation known in the art. The sphere of the first $Al_2O_3$ particles has an inner hole diameter of 0.3-0.8 μm and a diameter of 40-80 μm. That is, pores having a diameter of 0.3-0.8 μm are distributed inside the $Al_2O_3$ particles having a diameter of 40-80 μm.

According to one preferred embodiment of the present invention, the first oxide particles have at least two average particle sizes, wherein a first average particle size is 40-60 μm and a second average particle size is 5-8 μm, wherein a proportion of the first oxide particles having the first average particle size is 8-13 wt %, and a proportion of the first oxide particles having the second average particle size is 3-5 wt %, based on a total weight of the first thermal insulation layer.

In this embodiment, the first oxide particles have at least two different average particle sizes, so that the porosity and pore size defined above can be more conveniently formed in combination with the first $Al_2O_3$ particles. According to the present invention, the first oxide particles having different average particle sizes may be any one of first $SiO_2$ particles, first CaO particles, and first MgO particles, or a combination of any two or all of the three. For example, the first thermal insulation layer may consist of the first $Al_2O_3$ particles and the first $SiO_2$ particles having two or more average particle sizes, and of course, the first $SiO_2$ particles may be replaced with the first CaO particles or the first MgO particles, or the first thermal insulation layer may consist of the first $Al_2O_3$ particles, the first $SiO_2$ particles, and the first CaO particles. The first $SiO_2$ particles and the first CaO particles have an average particle size of 40-60 μm and 5-8 μm, respectively, or the first $SiO_2$ particles and the first CaO particles have each two average particle sizes of 40-60 μm and 5-8 μm. Of course, the combination of the first oxide particles in the first thermal insulation layer is not limited thereto.

According to one example of the present invention, the first thermal insulation layer is composed of first $Al_2O_3$ particles, first $SiO_2$ particles, first CaO particles, first MgO particles, and a first binder, wherein a sphere of the first $Al_2O_3$ particles has an inner hole diameter of 0.3-0.8 μm and a diameter of 40-80 μm, the first $SiO_2$ particles have a size of 40-60 μm, the first CaO particles have a size of 5-8 μm, and the first MgO particles have a size of 5-8 μm.

Particularly preferably, a proportion of the first $Al_2O_3$ hollow spherical particles is 80-85 wt %, a proportion of the first $SiO_2$ particles is 8-13 wt %, a proportion of the first CaO particles is 1-2 wt %, a proportion of the first MgO particles is 2-3 wt %, and a proportion of the first binder is 2-5 wt %, based on a total weight of the first thermal insulation layer. In the above example, different oxide particles can play different roles in a sintering process, so that a particularly good thermal insulation effect can be achieved.

Specifically, the overall thermal insulation effect of the first thermal insulation layer is improved by adjusting the proportion and particle size of each thermal insulation material in the first thermal insulation layer. First, first $Al_2O_3$ particles, first $SiO_2$ particles, first CaO particles, and first MgO particles are preliminarily mixed to obtain a preliminary mixture. Secondly, the preliminary mixture is rapidly mixed while the first binder needs to be added to obtain a preform. Finally, the preform is injected into a mold cavity, followed by jolt ramming, naturally cured, and released from the mold to obtain the first thermal insulation layer. For example, both preliminary mixing and rapid mixing processes may be performed by using a stirrer, but are not limited thereto. According to one example of the present invention, the preform of the first thermal insulation layer may be naturally cured for 72 h. The first binder may be water glass or silica sol, but is not limited thereto.

According to one embodiment of the present invention, the second $Al_2O_3$ particles have a size of 60-100 μm, and a proportion of the second $Al_2O_3$ particles is 40-50 wt % based on a total weight of the second thermal insulation layer.

According to one preferred embodiment of the present invention, the second oxide particles have at least two average particle sizes, wherein a third average particle size is 50-65 μm and a fourth average particle size is 5-10 μm, wherein a proportion of the second oxide particles having the third average particle size is 36-46 wt %, and a proportion of the second oxide particles having the fourth average particle size is 6-10 wt %, based on a total weight of the second thermal insulation layer.

In this embodiment, the second oxide particles have at least two different average particle sizes, so that the porosity and pore size defined above can be more conveniently formed. According to the present invention, the second oxide particles having different average particle sizes may be any one of the second $Al_2O_3$ particles, the second $SiO_2$ particles, the second CaO particles, and the second MgO particles, or a combination of any two, or a combination of any three, or all of the four. For example, the second thermal insulation layer may consist of second $Al_2O_3$ particles having two or more average particle sizes. Certainly, the second $Al_2O_3$ particles may be replaced with second $SiO_2$ particles or second CaO particles or second MgO particles. Alternatively, the second thermal insulation layer may also consist of second $SiO_2$ particles and second CaO particles, wherein the second $SiO_2$ particles and the second CaO particles have an average particle size of 50-65 μm and 5-10 μm, respectively, or the second $SiO_2$ particles and the second CaO particles have each two average particle sizes of 50-65 μm and 5-10 μm. Certainly, the combination of the second oxide particles in the second thermal insulation layer is not limited thereto.

According to one example of the present invention, the second thermal insulation layer is composed of the second $Al_2O_3$ particles, the second $SiO_2$ particles, the second CaO particles, the second MgO particles, and a second binder, wherein in the second thermal insulation layer, the second $Al_2O_3$ particles have a size of 60-100 μm, the second $SiO_2$ particles have a size of 50-65 μm, the second CaO particle have a size of 5-10 μm, and the second MgO particle have a size of 5-10 μm. Particularly preferably, a proportion of the second $Al_2O_3$ particles is 40-50 wt %, a proportion of the second $SiO_2$ particles is 36-46 wt %, a proportion of the second CaO particles is 3-5 wt %, a proportion of the second MgO particles is 3-5 wt %, and a proportion of the second binder is 4-8 wt %, based on the total weight of the second thermal insulation layer. In the above example, different oxide particles can play different roles in a sintering process, so that a particularly good thermal insulation effect can be achieved.

Specifically, a process for preparing the second thermal insulation layer is as follows: firstly, second $Al_2O_3$ particles, second $SiO_2$ particles, second CaO particles, and second MgO particles are preliminarily mixed to obtain a preliminary mixture. Secondly, the preliminary mixture is rapidly mixed while the second binder needs to be added to obtain a preform. Finally, the preform is injected into a mold cavity, followed by jolt ramming, naturally cured, and released from the mold to obtain the second thermal insulation layer. For example, both preliminary mixing and rapid mixing processes may be performed by using a stirrer, but are not limited thereto. According to one example of the present invention, the preform of the second thermal insulation layer may be naturally cured for 12 h. The second binder may be water glass or silica sol, but is not limited thereto.

According to one embodiment of the present invention, a proportion of $ZrO_2$ particles in the liner contact layer is 88-93 wt % based on a total weight of the liner contact layer. Specifically, a wetting angle between $ZrO_2$ and molten aluminum alloy is close to 180 degrees. When the wetting angle is 180 degrees, it means completely non-wetting. Therefore, the liner contact layer having $ZrO_2$ as a main component is not wetted with the molten aluminum alloy.

At present, a liner contact layer of a casting ladle is mainly made of a composite ceramic brick. In the process of use, an oxidation reaction is easy to occur on a contact surface with molten aluminum alloy due to long-term action with the high-temperature molten aluminum alloy, resulting in a small wetting angle between the liner contact layer and the molten aluminum alloy. Finally, aluminum slag will adhere to the surface of the liner layer to form a large slag nodule, which may cause the capacity of the casting ladle to become smaller and increase the chance of slag inclusion in the molten aluminum alloy, making it very unfavorable to the quality of the molten aluminum alloy. Further, cleaning aluminum slag on the inner wall of the casting ladle will increase labor intensity of the workers and reduce the production efficiency. The casting ladle for casting aluminum alloy according to the present invention has a liner contact layer mainly composed of $ZrO_2$, which is hardly wetted with the molten aluminum alloy, so that oxides can be guaranteed to be not adhered to the inner wall of the casting ladle to the maximum extent, thereby achieving no aluminum slag adhesion on the inner wall of the casting ladle, and ensuring the purity of the molten aluminum alloy. Meanwhile, the labor intensity of the workers can be reduced and the production efficiency can be improved.

In addition, $ZrO_2$ has a melting point of about 2680° C., stable chemical properties at high temperature, good thermal shock resistance, strong oxidation resistance, and strong thermal shock resistance, does not volatilize in a high temperature environment, does not produce toxic and harmful substances, and is suitable for being used as a liner contact layer of a casting ladle to be in direct contact with molten aluminum alloy. At present, the liner contact layer of the casting ladle is mainly made of a composite ceramic brick. In the process of use, cracks are easily generated inside the contact layer due to thermal shock, and the generation and expansion of a large number of cracks eventually lead to the scrapping of casting ladles. However, the casting ladle for casting aluminum alloy according to the present invention has a liner contact layer mainly composed of $ZrO_2$, which has strong thermal impact resistance and is not liable to crack.

According to one embodiment of the present invention, the liner contact layer has a porosity of 3-7% and a pore size of 10-15 μm.

Specifically, the liner contact layer has small porosity and small pore size, thereby ensuring the strength of the liner contact layer. Under the constant impact of high-temperature molten aluminum alloy, it is guaranteed that the liner contact layer is firm, and the thermal insulation effect of $ZrO_2$ is greatly exerted.

According to one example of the present invention, the liner contact layer is composed of $ZrO_2$ particles, third $Al_2O_3$ particles, third $SiO_2$ particles, and a third binder. In the liner contact layer, the $ZrO_2$ particles have a size of 10-30 μm, the third $Al_2O_3$ particles have a size of 40-80 μm, and the third $SiO_2$ particles have a size of 40-60 μm.

Preferably, a proportion of the third $Al_2O_3$ particles is 4-10 wt %, a proportion of the third $SiO_2$ particles is 1-3 wt %, and a proportion of the third binder is 1-2 wt %.

Specifically, in the liner contact layer, a high proportion of $ZrO_2$ particles can ensure no wetting with the molten aluminum alloy to achieve an effect of no aluminum adhesion. The third $Al_2O_3$ particles and the third $SiO_2$ particles as a filler material ensure the strength and firmness of the liner contact layer.

Specifically, first, $ZrO_2$ particles, third $Al_2O_3$ particles, and third $SiO_2$ particles are preliminarily mixed to obtain a preliminary mixture. Secondly, the preliminary mixture is rapidly mixed while the third binder needs to be added to obtain a preform. Finally, the preform is injected into a mold cavity, followed by jolt ramming, naturally cured, and released from the mold to obtain the liner contact layer. For example, both preliminary mixing and rapid mixing processes may be performed by using a stirrer, but are not limited thereto. According to one example of the present invention, the preform of the liner contact layer may be naturally cured for 84 h. The third binder may be aluminum dihydrogen phosphate, because the third binder is used in the liner contact layer and is required to have high temperature resistance and strong cohesive force in consideration of direct contact with the molten aluminum alloy.

According to one embodiment of the present invention, the housing layer may be a steel housing, but is not limited thereto.

The casting ladle for casting aluminum alloy of the present invention includes the liner contact layer, the first thermal insulation layer, the second thermal insulation layer, and the housing layer sequentially from inside to outside. The liner contact layer is mainly in direct contact with the molten aluminum alloy, and needs to meet the requirements of high melting point, high temperature resistance, heat shock resistance, heat corrosion resistance, high temperature oxidation resistance, non-adhesion with aluminum slag, non-volatilization, and no pollution. The first thermal insulation layer needs to have a good thermal insulation effect. The second thermal insulation layer is mainly a filling layer of a thermal insulating material and located in a transition region between the first thermal insulation layer and the housing layer. The housing layer mainly plays a supporting and protecting role. Because furnace burdens have high porosity, large pore size and poor resistance to external force, the housing layer is required for protection.

In the casting ladle for casting aluminum alloy according to the present invention, after being prepared, the liner contact layer, the first thermal insulation layer, the second thermal insulation layer and the housing layer need to be assembled by the following method: the prepared liner contact layer, the prepared first thermal insulation layer, the prepared second thermal insulation layer and the prepared housing layer are combined and then heated for baking, firstly, after rapid heating to 180° C., thermal insulation treatment is carried out; secondly, after rapid heating to 850° C., thermal insulation treatment is carried out; and finally, after rapid heating to 1100° C., thermal insulation treatment is carried out to obtain the casting ladle. For example, a heating rate at a low temperature stage (room temperature to 180° C.) is 60° C./h, with 36 h of thermal insulation after reaching the temperature; a heating rate at an intermediate temperature stage (180° C.-850° C.) is 100° C./h, with 48 h of thermal insulation after reaching the temperature; a heating rate at a high temperature stage (850° C.-1100° C.) is 100° C./h, with 36 h of thermal insulation after reaching the temperature.

In the casting ladle for casting aluminum alloy according to the present invention, all of thermal insulating materials used in the liner contact layer, the first thermal insulation layer, the second thermal insulation layer and the housing layer are conventional refractories, which may be produced in a mature and stable process, thereby facilitating control of the production cost of the casting ladle.

According to the casting ladle for casting aluminum alloy of the present invention, due to high porosity and large pore size of the first and second thermal insulation layers in the casting ladle, heat needs to pass through different solid-gas phase interfaces when being transmitted in the first and second thermal insulation layers, causing heat to remain mostly in the gas in pores, thereby achieving low heat diffusion, ensuring a good thermal insulation effect, further avoiding baking the casting ladle with natural gas when transferring molten aluminum alloy again, and meanwhile, achieving the purpose of reducing energy consumption, saving cost and protecting the environment. Meanwhile, by designing the composition of the second thermal insulation layer in the casting ladle to be $Al_2O_3$ particles and $SiO_2$ particles in high proportion, the amount of change in the magnitude of thermal expansion and contraction of the liner contact layer and the first thermal insulation layer is compensated, thereby reducing cracks caused by thermal shock. Further, since the liner contact layer of the casting ladle has a high proportion of $ZrO_2$, and the wetting angle between $ZrO_2$ and the molten aluminum alloy is close to 180 degrees, the liner contact layer is not wetted with the molten aluminum alloy, so that an effect that aluminum is not adhered to the inner wall of the casting ladle can be achieved.

Figure 1:
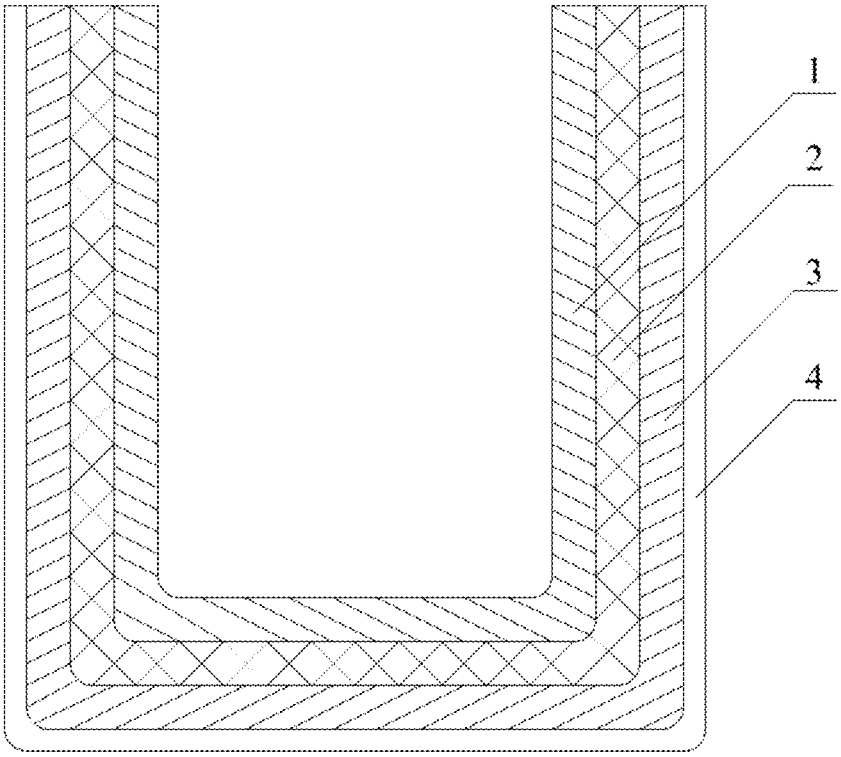
FIG. 1 is a structural schematic diagram of a casting ladle according to the present invention.

The figures include: 1—liner contact layer; 2—first thermal insulation layer; 3—second thermal insulation layer; and 4—housing layer.

DETAILED DESCRIPTION

Technical solutions in the embodiments of the present invention will be described clearly and completely below in conjunction with the embodiments and accompanying drawings of the present invention. It will be apparent that the described embodiments are merely a part of the embodiments of the present invention and not all of the embodiments. Based on the embodiments of the present invention, all other embodiments obtained by those of ordinary skill in the art without creative effort are within the protection scope of the present invention.

The present invention will be further illustrated below with reference to exemplary examples shown in the accompanying drawings. The advantages of various aspects of the present invention will be more apparent from the following description. Same reference numerals in the drawings refer to same components. The shapes and dimensions of the components in the schematic drawings are for illustration only and cannot be considered to embody actual shapes, dimensions and absolute positions.

The present invention provides a casting ladle for casting aluminum alloy. As shown in FIG. 1, the casting ladle of the present invention includes a liner contact layer 1, a first thermal insulation layer 2, a second thermal insulation layer 3, and a housing layer 4 sequentially from inside to outside.

A thickness of the liner contact layer 1 may be 70-110 mm, for example, the thickness of the liner contact layer 1 may be 75 mm or 90 mm, but is not limited thereto. A thickness of the first thermal insulation layer 2 may be 40-60 mm, for example, the thickness of the first thermal insulation layer 2 may be 47 mm or 50 mm, but is not limited thereto. A thickness of the second thermal insulation layer 3 may be 20-40 mm, for example, the thickness of the second thermal insulation layer may be 25 mm or 35 mm, but is not limited thereto. A thickness of the housing layer 4 may be 25-35 mm, for example, the thickness of the housing layer may be 30 mm.

According to one specific embodiment, the liner contact layer includes $ZrO_2$ particles, $Al_2O_3$ particles, and $SiO_2$ particles; the first thermal insulation layer includes $Al_2O_3$ particles, $SiO_2$ particles, CaO particles, and MgO particles; the second thermal insulation layer includes $Al_2O_3$ particles, $SiO_2$ particles, CaO particles, and MgO particles; and the housing layer is a steel housing. The proportion of each composition is calculated in parts by weight.

Example 1

A liner contact layer is composed of $ZrO_2$ particles, $Al_2O_3$ particles, $SiO_2$ particles and a binder aluminum dihydrogen phosphate. In the liner contact layer, a proportion of the $ZrO_2$ particles is 88 wt %, a proportion of the $Al_2O_3$ particles is 10 wt %, a proportion of the $SiO_2$ particles is 1 wt %, and a proportion of aluminum dihydrogen phosphate is 1 wt %. The size of the $ZrO_2$ particles is 10 μm, the size of the $Al_2O_3$ particles is 40 μm, and the size of the $SiO_2$ particles is 40 μm. The entire liner contact layer is required to have a refractoriness higher than 1650° C., with a porosity of 3% and a pore size of 10 μm.

The materials of the liner contact layer, namely the $ZrO_2$ particles, the $Al_2O_3$ particles and the $SiO_2$ particles specified above were preliminarily mixed by a stirrer at a speed of 500 r/min to obtain a preliminary mixture. Then, the obtained preliminary mixture was rapidly mixed to obtain a preform, wherein in the rapid mixing stage, aluminum dihydrogen phosphate needed to be added to be used as a binder, and a speed of the stirrer was 680 r/min. The obtained preform was injected into a mold cavity followed by jolt ramming, and then naturally cured for 84 h. Finally, mold release was carried out to obtain the liner contact layer.

A first thermal insulation layer is composed of $Al_2O_3$ particles, $SiO_2$ particles, CaO particles, MgO particles and a binder water glass. In the first thermal insulation layer, a proportion of a hollow $Al_2O_3$ sphere is 80 wt %, a proportion of the $SiO_2$ particles is 13 wt %, a proportion of the CaO particles is 1.5 wt %, a proportion of the MgO particles is 2.5 wt %, and a proportion of the water glass is 3 wt %. The $Al_2O_3$ particles have a hollow spherical structure, in which an inner hole diameter of the sphere is 0.3 μm, and a diameter of the sphere is 40 μm. The size of the $SiO_2$ particles is 40 μm. Both CaO and MgO are granular, with a size of 5 μm. The entire first thermal insulation layer has a refractoriness higher than 1560° C., a porosity of 55% and a pore size of 0.8 mm.

The materials of the first thermal insulation layer materials, namely the $Al_2O_3$ particles, the $SiO_2$ particles, the CaO particles and the MgO particles specified above were preliminarily mixed by a stirrer at a speed of 400 r/min to obtain a preliminary mixture. Then, the obtained preliminary mixture was rapidly mixed to obtain a preform, wherein in the rapid mixing stage, water glass needed to be added to be used as a binder, and a speed of the stirrer was 480 r/min. The obtained preform was injected into a mold cavity followed by jolt ramming, and then naturally cured for 72 h. Finally, mold release was carried out to obtain the first thermal insulation layer.

A second thermal insulation layer is composed of $Al_2O_3$ particles, $SiO_2$ particles, CaO particles, and MgO particles and a binder silica sol. In the second thermal insulation layer, a proportion of the $Al_2O_3$ particles is 40 wt %, a proportion of the $SiO_2$ particles is 46 wt %, a proportion of the CaO particles is 5 wt %, a proportion of the MgO particles is 5 wt %, and a proportion of the silica sol is 4 wt %. The $Al_2O_3$ particles have a size of 60 μm, and the $SiO_2$ particles have a size of 50 μm. Both CaO and MgO are granular, with a size of 5 μm. The entire second thermal insulation layer has a refractoriness higher than 1100° C., a porosity of 60% and a pore size of 2 mm.

The materials of the second thermal insulation layer, namely the $Al_2O_3$ particles, the $SiO_2$ particles, the CaO particles, and the MgO particles specified above were mixed by a stirrer at a speed of 300 r/min to obtain a mixed material, wherein to the stirring process, silica sol was added to be used as a binder. The resulting mixed material was injected into a mold cavity and then naturally cured for 12 h. Finally, mold release was carried out to obtain the second thermal insulation layer.

The liner contact layer, the first thermal insulation layer, and the second thermal insulation layer prepared above and a steel housing layer were combined and then heated and baked. In a low temperature stage (from room temperature to 180° C.), the heating was performed at a rate of 60° C./h, and after reaching the temperature, the temperature was maintained for 36 h. In an intermediate temperature stage (180° C.-850° C.), the heating was performed at a rate of 100° C./h, and after reaching the temperature, the temperature was maintained for 48 h. In a high temperature stage (850° C.-1100° C.), the heating was performed at a rate of 100° C./h, and after reaching the temperature, the temperature was maintained for 36 h. Finally, a casting ladle for casting aluminum alloy was obtained.

Example 2

A liner contact layer is composed of $ZrO_2$ particles, $Al_2O_3$ particles, $SiO_2$ particles and a binder aluminum dihydrogen phosphate. In the liner contact layer, a proportion of the $ZrO_2$ particles is 90 wt %, a proportion of the $Al_2O_3$ particles is 5 wt %, a proportion of the $SiO_2$ particles is 3 wt %, and a proportion of aluminum dihydrogen phosphate is 2 wt %. The size of the $ZrO_2$ particles is 20 μm, the size of the $Al_2O_3$ particles is 60 μm, and the size of the $SiO_2$ particles is 50 μm. The entire liner contact layer is required to have a refractoriness higher than 1650° C., with a porosity of 5% and a pore size of 12 μm.

The materials of the liner contact layer, namely the $ZrO_2$ particles, the $Al_2O_3$ particles and the $SiO_2$ particles specified above were preliminarily mixed by a stirrer at a speed of 500 r/min to obtain a preliminary mixture. Then, the obtained preliminary mixture was rapidly mixed to obtain a preform, wherein in the rapid mixing stage, aluminum dihydrogen phosphate needed to be added to be used as a binder, and a speed of the stirrer was 680 r/min. The obtained preform was injected into a mold cavity followed by jolt ramming, and then naturally cured for 84 h. Finally, mold release was carried out to obtain the liner contact layer.

A first thermal insulation layer is composed of $Al_2O_3$ particles, $SiO_2$ particles, CaO particles, MgO particles and a binder water glass. In the first thermal insulation layer, a proportion of a hollow $Al_2O_3$ sphere is 83 wt %, a proportion of the $SiO_2$ particles is 8 wt %, a proportion of the CaO particles is 1.0 wt %, a proportion of the MgO particles is 3.0 wt %, and a proportion of the water glass is 5 wt %. The $Al_2O_3$ particles have a hollow spherical structure, in which an inner hole diameter of the sphere is 0.5 μm, and a diameter of the sphere is 60 μm. The size of the $SiO_2$ particles is 50 μm. Both CaO and MgO are granular, with a size of 6 μm. The entire first thermal insulation layer has a refractoriness higher than 1560° C., a porosity of 60% and a pore size of 2.5 mm.

The materials of the first thermal insulation layer, namely the $Al_2O_3$ particles, the $SiO_2$ particles, the CaO particles and the MgO particles specified above were preliminarily mixed by a stirrer at a speed of 400 r/min to obtain a preliminary mixture. Then, the obtained preliminary mixture was rapidly mixed to obtain a preform, wherein in the rapid mixing stage, water glass needed to be added to be used as a binder, and a speed of the stirrer was 480 r/min. The obtained preform was injected into a mold cavity followed by jolt ramming, and then naturally cured for 72 h. Finally, mold release was carried out to obtain the first thermal insulation layer.

A second thermal insulation layer is composed of $Al_2O_3$ particles, $SiO_2$ particles, CaO particles, MgO particles and a binder silica sol. In the second thermal insulation layer, a proportion of the $Al_2O_3$ particles is 48 wt %, a proportion of the $SiO_2$ particles is 38 wt %, a proportion of the CaO particles is 4 wt %, a proportion of the MgO particles is 4 wt %, and a proportion of the silica sol is 6 wt %. The $Al_2O_3$ particles have a size of 80 μm, and the $SiO_2$ particles have a size of 60 μm. Both CaO and MgO are granular, with a size of 8 μm. The entire second thermal insulation layer has a refractoriness higher than 1100° C., a porosity of 70% and a pore size of 3 mm.

The materials of the second thermal insulation layer, namely the $Al_2O_3$ particles, the $SiO_2$ particles, the CaO particles, and the MgO particles specified above were mixed by a stirrer at a speed of 300 r/min to obtain a mixed material, wherein in the stirring process, silica sol was added to be used as a binder. The resulting mixed material was injected into a mold cavity and then naturally cured for 12 h. Finally, mold release was carried out to obtain the second thermal insulation layer.

The liner contact layer, the first thermal insulation layer, and the second thermal insulation layer prepared above and a steel housing layer were combined and then heated and baked. In a low temperature stage (from room temperature to 180° C.), the heating was performed at a rate of 60° C./h, and after reaching the temperature, the temperature was maintained for 36 h. In an intermediate temperature stage (180° C.-850° C.), the heating was performed at a rate of 100° C./h, and after reaching the temperature, the temperature was maintained for 48 h. In a high temperature stage (850° C.-1100° C.), the heating was performed at a rate of 100° C./h, and after reaching the temperature, the temperature was maintained for 36 h. Finally, a casting ladle for casting aluminum alloy was obtained.

Example 3

A liner contact layer is composed of $ZrO_2$ particles, $Al_2O_3$ particles, $SiO_2$ particles and a binder aluminum dihydrogen phosphate. In the liner contact layer, a proportion of the $ZrO_2$ particles is 93 wt %, a proportion of the $Al_2O_3$ particles is 4 wt %, a proportion of the $SiO_2$ particles is 1.5 wt %, and a proportion of aluminum dihydrogen phosphate is 1.5 wt %. The size of the $ZrO_2$ particles is 30 μm, the size of the $Al_2O_3$ particles is 80 μm, and the size of the $SiO_2$ particles is 60 μm. The entire liner contact layer is required to have a refractoriness higher than 1650° C., with a porosity of 7% and a pore size of 15 μm.

The materials of the liner contact layer, namely the $ZrO_2$ particles, the $Al_2O_3$ particles and the $SiO_2$ particles specified above were preliminarily mixed by a stirrer at a speed of 500 r/min to obtain a preliminary mixture. Then, the obtained preliminary mixture was rapidly mixed to obtain a preform, wherein in the rapid mixing stage, aluminum dihydrogen phosphate needed to be added to be used as a binder, and a speed of the stirrer was 680 r/min. The obtained preform was injected into a mold cavity followed by jolt ramming, and then naturally cured for 84 h. Finally, mold release was carried out to obtain the liner contact layer.

A first thermal insulation layer is composed of $Al_2O_3$ particles, $SiO_2$ particles, CaO particles, MgO particles and a binder water glass. In the first thermal insulation layer, a proportion of a hollow $Al_2O_3$ sphere is 85 wt %, a proportion of the $SiO_2$ particles is 9 wt %, a proportion of the CaO particles is 2.0 wt %, a proportion of the MgO particles is 2.0 wt %, and a proportion of the water glass is 2 wt %. The $Al_2O_3$ particles have a hollow spherical structure, in which an inner hole diameter of the sphere is 0.8 μm, and a diameter of the sphere is 80 μm. The size of the $SiO_2$ particles is 60 μm. Both CaO and MgO are granular, with a size of 8 μm. The entire first thermal insulation layer is required to have a refractoriness higher than 1560° C., with a porosity of 65% and a pore size of 3.0 mm.

The materials of the first thermal insulation layer, namely the $Al_2O_3$ particles, the $SiO_2$ particles, the CaO particles and the MgO particles specified above were preliminarily mixed by a stirrer at a speed of 400 r/min to obtain a preliminary mixture. Then, the obtained preliminary mixture was rapidly mixed to obtain a preform, wherein in the rapid mixing stage, water glass needed to be added to be used as a binder, and a speed of the stirrer was 480 r/min. The obtained preform was injected into a mold cavity followed by jolt ramming, and then naturally cured for 72 h. Finally, mold release was carried out to obtain the first thermal insulation layer.

A second thermal insulation layer is composed of $Al_2O_3$ particles, $SiO_2$ particles, CaO particles, MgO particles and a binder silica sol. In the second thermal insulation layer, a proportion of the $Al_2O_3$ particles is 50 wt %, a proportion of the $SiO_2$ particles is 36 wt %, a proportion of the CaO particles is 3 wt %, a proportion of the MgO particles is 3 wt %, and a proportion of the silica sol is 8 wt %. The $Al_2O_3$ particles have a size of 100 μm, and the $SiO_2$ particles have a size of 65 μm. Both CaO and MgO are granular, with a size of 10 μm. The entire second thermal insulation layer is required to have a refractoriness higher than 1100° C., with a porosity of 75% and a pore size of 5 mm.

The materials of the second thermal insulation layer, namely the $Al_2O_3$ particles, the $SiO_2$ particles, the CaO particles, and the MgO particles specified above were mixed by a stirrer at a speed of 300 r/min to obtain a mixed material, wherein in the stirring process, silica sol was added to be used as a binder. The resulting mixed material was injected into a mold cavity and then naturally cured for 12 h. Finally, mold release was carried out to obtain the second thermal insulation layer.

The liner contact layer, the first thermal insulation layer, and the second thermal insulation layer prepared above and a steel housing layer were combined and then heated and baked. In a low temperature stage (from room temperature to 180° C.), the heating was performed at a rate of 60° C./h, and after reaching the temperature, the temperature was maintained for 36 h. In an intermediate temperature stage (180° C.-850° C.), the heating was performed at a rate of 100° C./h, and after reaching the temperature, the temperature was maintained for 48 h. In a high temperature stage (850° C.-1100° C.), the heating was performed at a rate of 100° C./h, and after reaching the temperature, the temperature was maintained for 36 h. Finally, a casting ladle for casting aluminum alloy was obtained.

Comparative Example 1: Conventional Casting Ladle

A conventional casting ladle includes a composite ceramic brick, a heavy coke oven material layer, a thermal insulation layer, a cotton insulation layer and a furnace housing sequentially from inside to outside. The composite ceramic brick is formed from $TiO_2$ and $Al_2O_3$ by sintering at 1450° C., and a major component thereof is $Al_2TiO_5$ generated. A heavy coke oven material is mainly $Al_2O_3$. The thermal insulation layer is a refractory fiberboard of 20 mm. The cotton insulation layer is an insulating cotton of 3-5 mm. The furnace housing is a steel housing.

Comparative Example 2

A liner contact layer is composed of $ZrO_2$ particles, $Al_2O_3$ particles, $SiO_2$ particles and a binder aluminum dihydrogen phosphate. In the liner contact layer, a proportion of the $ZrO_2$ particles is 95 wt %, a proportion of the $Al_2O_3$ particles is 2 wt %, a proportion of the $SiO_2$ particles is 0.5 wt %, and a proportion of aluminum dihydrogen phosphate is 1.0 wt %. The size of the $ZrO_2$ particles is 8 μm, the size of the $Al_2O_3$ particles is 30 μm, and the size of the $SiO_2$ particles is 30 μm. The entire liner contact layer is required to have a refractoriness higher than 1650° C., with a porosity of 2% and a pore size of 8 μm.

The materials of the liner contact layer, namely the $ZrO_2$ particles, the $Al_2O_3$ particles and the $SiO_2$ particles specified above were preliminarily mixed by a stirrer at a speed of 500 r/min to obtain a preliminary mixture. Then, the obtained preliminary mixture was rapidly mixed to obtain a preform, wherein in the rapid mixing stage, aluminum dihydrogen phosphate needed to be added to be used as a binder, and a speed of the stirrer was 680 r/min. The obtained preform was injected into a mold cavity followed by jolt ramming, and then naturally cured for 84 h. Finally, mold release was carried out to obtain the liner contact layer.

A first thermal insulation layer is composed of $Al_2O_3$ particles, $SiO_2$ particles, CaO particles, MgO particles and a binder water glass. In the first thermal insulation layer, a proportion of a hollow $Al_2O_3$ sphere is 90 wt %, a proportion of the $SiO_2$ particles is 6.0 wt %, a proportion of the CaO particles is 0.5 wt %, a proportion of the MgO particles is 1.0 wt %, and a proportion of the water glass is 1.5 wt %. The $Al_2O_3$ particles have a hollow spherical structure, in which an inner hole diameter of the sphere is 0.2 μm, and a diameter of the sphere is 30 μm. The size of the $SiO_2$ particles is 35 μm. Both CaO and MgO are granular, with a size of 4 μm. The entire first thermal insulation layer is required to have a refractoriness higher than 1560° C., with a porosity of 50% and a pore size of 0.6 mm.

The materials of the first thermal insulation layer, namely the $Al_2O_3$ particles, the $SiO_2$ particles, the CaO particles and the MgO particles specified above were preliminarily mixed by a stirrer at a speed of 400 r/min to obtain a preliminary mixture. Then, the obtained preliminary mixture was rapidly mixed to obtain a preform, wherein in the rapid mixing stage, water glass needed to be added to be used as a binder, and a speed of the stirrer was 480 r/min. The obtained preform was injected into a mold cavity followed by jolt ramming, and then naturally cured for 72 h. Finally, mold release was carried out to obtain the first thermal insulation layer.

A second thermal insulation layer is composed of $Al_2O_3$ particles, $SiO_2$ particles, CaO particles, MgO particles and a binder silica sol. In the second thermal insulation layer, a proportion of the $Al_2O_3$ particles is 56 wt %, a proportion of the $SiO_2$ particles is 20 wt %, a proportion of the CaO particles is 7 wt %, a proportion of the MgO particles is 7 wt %, and a proportion of the silica sol is 10 wt %. The $Al_2O_3$ particles have a size of 40 μm, and the $SiO_2$ particles have a size of 45 μm. Both CaO and MgO are granular, with a size of 3 μm. The entire second thermal insulation layer is required to have a refractoriness higher than 1100° C., with a porosity of 50% and a pore size of 1.5 mm.

The materials of the second thermal insulation layer, namely the $Al_2O_3$ particles, the $SiO_2$ particles, the CaO particles, and the MgO particles specified above were mixed by a stirrer at a speed of 300 r/min to obtain a mixed material, wherein in the stirring process, silica sol was added to be used as a binder. The resulting mixed material was injected into a mold cavity and then naturally cured for 12 h. Finally, mold release was carried out to obtain the second thermal insulation layer.

The liner contact layer, the first thermal insulation layer, and the second thermal insulation layer prepared above and a steel housing layer were combined and then heated and baked. In a low temperature stage (from room temperature to 180° C.), the heating was performed at a rate of 60° C./h, and after reaching the temperature, the temperature was maintained for 36 h. In an intermediate temperature stage (180° C.-850° C.), the heating was performed at a rate of 100° C./h, and after reaching the temperature, the temperature was maintained for 48 h. In a high temperature stage (850° C.-1100° C.), the heating was performed at a rate of 100° C./h, and after reaching the temperature, the temperature was maintained for 36 h. Finally, a casting ladle for casting aluminum alloy was obtained.

Comparative Example 3

A liner contact layer is composed of $ZrO_2$ particles, $Al_2O_3$ particles, $SiO_2$ particles and a binder aluminum dihydrogen phosphate. In the liner contact layer, a proportion of the $ZrO_2$ particles is 80 wt %, a proportion of the $Al_2O_3$ particles is 12 wt %, a proportion of the $SiO_2$ particles is 4 wt %, and a proportion of aluminum dihydrogen phosphate is 4 wt %. The size of the $ZrO_2$ particles is 35 μm, the size of the $Al_2O_3$ particles is 90 μm, and the size of the $SiO_2$ particles is 70 μm. The entire liner contact layer is required to have a refractoriness higher than 1650° C., with a porosity of 9% and a pore size of 20 μm.

The materials of the liner contact layer, namely the $ZrO_2$ particles, the $Al_2O_3$ particles and the $SiO_2$ particles specified above were preliminarily mixed by a stirrer at a speed of 500 r/min to obtain a preliminary mixture. Then, the obtained preliminary mixture was rapidly mixed to obtain a preform, wherein in the rapid mixing stage, aluminum dihydrogen phosphate needed to be added to be used as a binder, and a speed of the stirrer was 680 r/min. The obtained preform was injected into a mold cavity followed by jolt ramming, and then naturally cured for 84 h. Finally, mold release was carried out to obtain the liner contact layer.

A first thermal insulation layer is composed of $Al_2O_3$ particles, $SiO_2$ particles, CaO particles, MgO particles and a binder water glass. In the first thermal insulation layer, a proportion of a hollow $Al_2O_3$ sphere is 68 wt %, a proportion of the $SiO_2$ particles is 15 wt %, a proportion of the CaO particles is 4.0 wt %, a proportion of the MgO particles is 5.0 wt %, and a proportion of the water glass is 8 wt %. The $Al_2O_3$ particles have a hollow spherical structure, in which an inner hole diameter of the sphere is 1.0 μm, and a diameter of the sphere is 100 μm. The size of the $SiO_2$ particles is 75 μm. Both CaO and MgO are granular, with a size of 12 μm. The entire first thermal insulation layer is required to have a refractoriness higher than 1560° C., with a porosity of 70% and a pore size of 5.0 mm.

The materials of the first thermal insulation layer, namely the $Al_2O_3$ particles, the $SiO_2$ particles, the CaO particles and the MgO particles specified above were preliminarily mixed by a stirrer at a speed of 400 r/min to obtain a preliminary mixture. Then, the obtained preliminary mixture was rapidly mixed to obtain a preform, wherein in the rapid mixing stage, water glass needed to be added to be used as a binder, and a speed of the stirrer was 480 r/min. The obtained preform was injected into a mold cavity followed by jolt ramming, and then naturally cured for 72 h. Finally, mold release was carried out to obtain the first thermal insulation layer.

A second thermal insulation layer is composed of $Al_2O_3$ particles, $SiO_2$ particles, CaO particles, MgO particles and a binder silica sol. In the second thermal insulation layer, a proportion of the $Al_2O_3$ particles is 30 wt %, a proportion of the $SiO_2$ particles is 63 wt %, a proportion of the CaO particles is 2 wt %, a proportion of the MgO particles is 2 wt %, and a proportion of the silica sol is 3 wt %. The $Al_2O_3$ particles have a size of 120 μm, and the $SiO_2$ particles have a size of 80 μm. Both CaO and MgO are granular, with a size of 15 μm. The entire second thermal insulation layer is required to have a refractoriness higher than 1100° C., with a porosity of 80% and a pore size of 7 mm.

The materials of the second thermal insulation layer, namely the $Al_2O_3$ particles, the $SiO_2$ particles, the CaO particles, and the MgO particles specified above were mixed by a stirrer at a speed of 300 r/min to obtain a mixed material, wherein in the stirring process, silica sol was added to be used as a binder. The resulting mixed material was injected into a mold cavity and then naturally cured for 12 h. Finally, mold release was carried out to obtain the second thermal insulation layer.

The liner contact layer, the first thermal insulation layer, and the second thermal insulation layer prepared above and a steel housing layer were combined and then heated and baked. In a low temperature stage (from room temperature to 180° C.), the heating was performed at a rate of 60° C./h, and after reaching the temperature, the temperature was maintained for 36 h. In an intermediate temperature stage (180° C.-850° C.), the heating was performed at a rate of 100° C./h, and after reaching the temperature, the temperature was maintained for 48 h. In a high temperature stage (850° C.-1100° C.), the heating was performed at a rate of 100° C./h, and after reaching the temperature, the temperature was maintained for 36 h. Finally, a casting ladle for casting aluminum alloy was obtained.

Thermal insulation performance test: used for testing a thermal insulation effect of casting ladles An equal amount of molten aluminum alloy was charged into the casting ladles in Examples 1, 2 and 3 and Comparative examples 1, 2 and 3, respectively, an initial temperature of the molten aluminum alloy was measured, and then, a temperature of the molten aluminum alloy was measured at 1, 3, 5, 7, 9, 15 and 20 min, respectively, which were recorded in Table 1. The molten aluminum alloy in the casting ladle was subjected to a degassing and refining process within 20 minutes and then supplied to a die casting machine.

As shown in Table 1, the molten aluminum alloys in Examples 1, 2 and 3 have the initial temperatures of 735° C., 738° C., and 736° C., respectively. After 20 minutes, the temperatures of the molten aluminum alloys were decreased to 731° C., 734° C., and 732° C., respectively, with a temperature decrease rate of about 0.2° C./min. In Comparative example 1, the molten aluminum alloy in the conventional casting ladle has an initial temperature of 735° C., and after 20 minutes, the temperature was decreased to 705° C., with a temperature decrease rate of 1.5° C./min. Thus, it can be explained that compared with the conventional casting ladle, the casting ladle of the present invention may achieve a good thermal insulation effect by designing parameters such as the shape, size, proportion, and porosity of the thermal insulation materials. In Comparative example 2, the first and second thermal insulation layers of the casting ladle have the porosity and pore size less than those of the casting ladle of the present invention, and the temperature decrease rate is 1.55° C./min. In Comparative example 3, the first and second thermal insulation layers of the casting ladle have the porosity and pore size larger than those of the casting ladle of the present invention, and the temperature decrease rate is 1.65° C./min. It is further shown that the casting ladle of the present invention achieves a good thermal insulation effect by reasonably adjusting the porosity and pore size of the first and second thermal insulation layers of the casting ladle.

TABLE 1

Temperature Statistical Table of Molten Aluminum Alloy in Casting Ladles

| Data for comparison | Initial Temperature (° C.) | At 1 min (° C.) | At 3 min (° C.) | At 5 min (° C.) | At 7 min (° C.) | At 9 min (° C.) | At 15 min (° C.) | At 20 min (° C.) |
|---|---|---|---|---|---|---|---|---|
| Example 1 | 735 | 734 | 734 | 734 | 733 | 733 | 732 | 731 |
| Example 2 | 738 | 738 | 737 | 737 | 736 | 735 | 735 | 734 |
| Example 3 | 736 | 735 | 735 | 734 | 734 | 733 | 733 | 732 |
| Comparative example 1 | 735 | 733 | 730 | 727 | 724 | 720 | 715 | 705 |
| Comparative example 2 | 735 | 733 | 729 | 727 | 723 | 720 | 714 | 704 |
| Comparative example 3 | 736 | 734 | 729 | 728 | 724 | 721 | 715 | 703 |

TABLE 2

Natural Gas Loss Statistical Table of Baking Casting Ladles

| Data for comparison | Frequency of ladle baking (ladle(s) per times) | Ladle baking time (min per ladle) | Number of ladles for producing aluminum (ladle) | Usage amount of natural gas ($m^3$/day) | Natural gas cost (Yuan/day) |
|---|---|---|---|---|---|
| Example 1 | No ladle baking | No ladle baking | 160 | 0 | 0 |
| Example 2 | No ladle baking | No ladle baking | 160 | 0 | 0 |

TABLE 2-continued

Natural Gas Loss Statistical Table of Baking Casting Ladles

| Data for comparison | Frequency of ladle baking (ladle(s) per times) | Ladle baking time (min per ladle) | Number of ladles for producing aluminum (ladle) | Usage amount of natural gas ($m^3$/day) | Natural gas cost (Yuan/day) |
|---|---|---|---|---|---|
| Example 3 | No ladle baking | No ladle baking | 160 | 0 | 0 |
| Comparative example 1 | 1 | 5 | 160 | 480 | 960 |
| Comparative example 2 | 1 | 5 | 160 | 480 | 960 |
| Comparative example 3 | 1 | 5 | 160 | 480 | 960 |

Table 2 is a statistical table showing the consumption of natural gas for on-site air-baking casting ladles in the workshop. As can be seen from Table 2, the casting ladles in Comparative examples 1, 2 and 3 have a greatly reduced inner temperature due to a poor thermal insulation effect, and the empty casting ladles need to be baked after return. However, in Examples 1, 2 and 3, the ladle baking process is not required, thereby reducing the factory cost, decreasing labor intensity of workers, saving energy while protecting the environment, and eliminating the safety hazard of scalding employees.

K-mold test: used for testing the slag content of molten aluminum alloy in casting ladle Reference is made to Standard NO. YS/T1004-2014, entitled molten aluminum and aluminum alloy, of the Nonferrous Metal Industry of the People's Republic of China, for a K-mold test method.

TABLE 3

Statistical table of K-mold test results of slag inclusions of molten aluminum alloy in casting ladles

| K-mold Sampling | $1^{st}$ time | $2^{nd}$ time | $3^{rd}$ time | $4^{th}$ time | $5^{th}$ time | Average |
|---|---|---|---|---|---|---|
| Example 1 | 0 | 0 | 0.1 | 0.1 | 0 | 0.04 |
| Example 2 | 0 | 0.1 | 0.1 | 0 | 0 | 0.04 |
| Example 3 | 0 | 0 | 0 | 0.1 | 0.1 | 0.04 |
| Comparative example 1 | 0.1 | 0.1 | 0.1 | 0.2 | 0.1 | 0.12 |
| Comparative example 2 | 0 | 0 | 0.1 | 0 | 0.1 | 0.04 |
| Comparative example 3 | 0.1 | 0 | 0 | 0.1 | 0 | 0.04 |

Table 3 shows K-mold test and analysis of the purity of molten aluminum alloy in casting ladles. In an actual production process in the workshops, a K-mold is usually used for quick analysis of slag inclusion in the molten aluminum. As can be seen from Table 3, in the conventional casting ladle of Comparative example 1, there are slag inclusions in the molten aluminum due to serious slag adhering on the wall of the casting ladle, and the average value of the K-mold test is 0.12. In Examples 1, 2, and 3 and Comparative examples 2 and 3, the average value of the K-mold test of the molten aluminum in casting ladles is 0.04 because aluminum slag is not adhered to the walls of casting ladles. Therefore, the present invention can achieve the effects of having no aluminum adhesion and improving the quality of the molten aluminum alloy.

Figure 2:
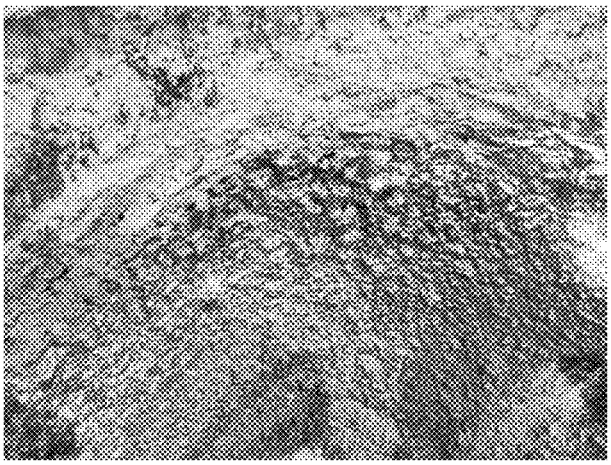
FIG. 2 is a photograph showing an entity that slag is adhered to an inner wall of a conventional casting ladle in one comparative example.
Figure 3:
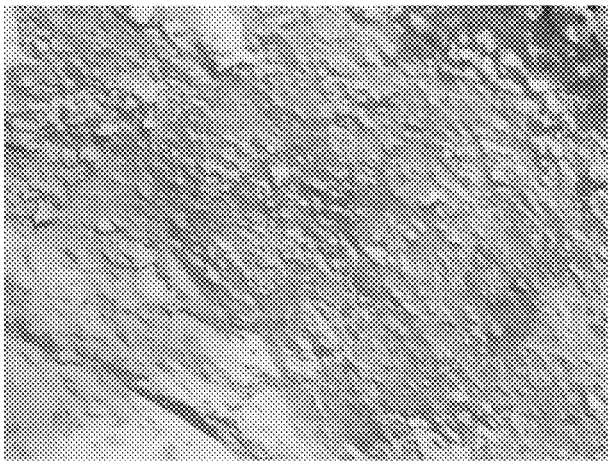
FIG. 3 is a photograph showing an entity that slag is adhered to an inner wall of a casting ladle according to one embodiment of the present invention.

As shown in FIG. 2, the amount of aluminum slag adhered to the inner wall of the conventional casting ladle in comparative example 1 is relatively large. As shown in FIG. 3, the amount of aluminum slag adhered to the inner wall of a casting ladle according to one embodiment of the present invention is significantly smaller than that of FIG. 2. Thus, it can be seen that the casting ladle of the present invention can indeed achieve the effects of having no aluminum adhesion and improving the quality of the molten aluminum alloy.

The foregoing description is only preferred embodiments of the present invention, and does not limit the patent scope of the present invention. Under the inventive concept of the present invention, the equivalent structure transformation made by using the contents of the description and accompanying drawings of the present invention, or the direct/indirect application in other related technical fields is included in the scope of patent protection of the present invention.

The invention claimed is:

1. A casting ladle for casting aluminum alloy, comprising a liner contact layer, a first thermal insulation layer, a second thermal insulation layer, and a housing layer sequentially from inside to outside, wherein:

the first thermal insulation layer comprises first $Al_2O_3$ particles and at least one first oxide particle selected from the group consisting of first $SiO_2$ particles, first CaO particles, and first MgO particles, wherein the first $Al_2O_3$ particles have a hollow spherical structure, a proportion of the first $Al_2O_3$ particles is 80-85 wt % based on a total weight of the first thermal insulation layer, and the first thermal insulation layer has a porosity of 55-65% and a pore size of 0.8-3.0 mm; and the second thermal insulation layer comprises at least one second oxide particle selected from the group consisting of second $Al_2O_3$ particles, second $SiO_2$ particles, second CaO particles, and second MgO particles, wherein the second thermal insulation layer has a porosity of 60-75% and a pore size of 2-5 mm.

2. The casting ladle for casting aluminum alloy according to claim 1, wherein a sphere of the first $Al_2O_3$ particles has an inner hole diameter of 0.3-0.8 μm and a diameter of 40-80 μm.

3. The casting ladle for casting aluminum alloy according to claim 2, wherein the first thermal insulation layer is composed of first $Al_2O_3$ particles, first $SiO_2$ particles, first CaO particles, first MgO particles, and a first binder, wherein the first $SiO_2$ particles have a size of 40-60 μm, the first CaO particles have a size of 5-8 μm, and the first MgO particles have a size of 5-8 μm;

a proportion of the first $SiO_2$ particles is 8-13 wt %, a proportion of the first CaO particles is 1-2 wt %, a proportion of the first MgO particles is 2-3 wt %, and a proportion of the first binder is 2-5 wt %, based on a total weight of the first thermal insulation layer.

4. The casting ladle for casting aluminum alloy according to claim 1, wherein the at least one first oxide particle has at least two average particle sizes, in which a first average particle size is 40-60 μm and a second average particle size is 5-8 μm, wherein a proportion of the at least one first oxide particle having the first average particle size is 8-13 wt %, and a proportion of the at least one first oxide particle having the second average particle size is 3-5 wt %, based on a total weight of the first thermal insulation layer.

5. The casting ladle for casting aluminum alloy according to claim 1, wherein the second $Al_2O_3$ particles have a size of 60-100 μm, and a proportion of the second $Al_2O_3$ particles is 40-50 wt % based on a total weight of the second thermal insulation layer.

6. The casting ladle for casting aluminum alloy according to claim 1, wherein the at least one second oxide particle has at least two average particle sizes, in which a first average particle size is 50-65 μm and a second average particle size is 5-10 μm, wherein a proportion of the at least one second oxide particle having the first average particle size is 36-46 wt %, and a proportion of the at least one second oxide particle having the second average particle size is 6-10 wt %, based on a total weight of the second thermal insulation layer.

7. The casting ladle for casting aluminum alloy according to claim 1, wherein the second thermal insulation layer is composed of the second $Al_2O_3$ particles, the second $SiO_2$ particles, the second CaO particles, the second MgO particles, and a second binder, wherein the second $Al_2O_3$ particles have a size of 60-100 μm, the second $SiO_2$ particles have a size of 50-65 μm, the second CaO particles have a size of 5-10 μm, and the second MgO particles have a size of 5-10 μm;

a proportion of the second $Al_2O_3$ particles is 40-50 wt %, a proportion of the second $SiO_2$ particles is 36-46 wt %, a proportion of the second CaO particles is 3-5 wt %, a proportion of the first MgO particles is 3-5 wt %, and a proportion of the second binder is 4-8 wt %, based on a total weight of the second thermal insulation layer.

8. The casting ladle for casting aluminum alloy according to claim 1, wherein a proportion of $ZrO_2$ particles in the liner contact layer is 88-93 wt % based on a total weight of the liner contact layer.

9. The casting ladle for casting aluminum alloy according to claim 8, wherein the liner contact layer has a porosity of 3-7% and a pore size of 10-15 μm.

10. The casting ladle for casting aluminum alloy according to claim 9, wherein in the liner contact layer, the $ZrO_2$ particles have a size of 10-30 μm, third $Al_2O_3$ particles have a size of 40-80 μm, and third $SiO_2$ particles have a size of 40-60 μm;

a proportion of the third $Al_2O_3$ particles is 4-10 wt %, a proportion of the third $SiO_2$ particles is 1-3 wt %, and a proportion of a third binder is 1-2 wt %, based on a total weight of the liner contact layer.

* * * * *